US005782125A

United States Patent [19]

Faggiani et al.

[11] Patent Number: 5,782,125

[45] Date of Patent: Jul. 21, 1998

[54] ASSEMBLY TO CLAMP A ROLLING RING

[75] Inventors: Eddy Faggiani; Gino Cattelani; Ferruccio Tomat, all of Udine, Italy

[73] Assignee: Danieli & C. Officine Meccaniche SpA, Buttrio, Italy

[21] Appl. No.: 740,605

[22] Filed: Oct. 31, 1996

[30] Foreign Application Priority Data

Nov. 9, 1995 [IT] Italy ..... UD95A0223

[51] Int. Cl.[6] ..... B21B 31/00

[52] U.S. Cl. ..... 72/237; 72/252; 29/256; 403/355

[58] Field of Search ..... 72/35, 237, 235, 72/238, 239, 247, 249; 29/252, 256, 263; 403/15, 281, 282, 370, 374

[56] References Cited

U.S. PATENT DOCUMENTS

| | | | |
|---|---|---|---|
| 3,514,136 | 5/1970 | Kennicott . | |
| 3,727,957 | 4/1973 | Brown et al. | 403/355 |
| 4,581,911 | 4/1986 | Shinomoto . | |
| 4,589,269 | 5/1986 | Michaux | 72/237 |
| 4,650,364 | 3/1987 | Kark | 72/237 |
| 4,776,078 | 10/1988 | Howard et al. | 29/252 |

FOREIGN PATENT DOCUMENTS

| | | |
|---|---|---|
| 099073 | 1/1984 | European Pat. Off. . |
| 214521 | 3/1987 | European Pat. Off. . |
| 321139 | 6/1989 | European Pat. Off. . |
| 342179 | 11/1989 | European Pat. Off. . |
| 0455082 | 11/1991 | European Pat. Off. . |
| 3834606 | 4/1990 | Germany . |

*Primary Examiner*—W. Donald Bray

*Attorney, Agent, or Firm*—Antonelli, Terry, Stout & Kraus, LLP

[57] ABSTRACT

Assembly (12) to clamp a rolling ring (10) associated with a ring-bearing shaft (11) of a rolling mill stand, the clamping assembly (12) comprising a labyrinth ring (13), an alignment bush (18), a cap (15), a spacer (14), a closure flange (16) and a locking screw (17), means (30, 31) performing rotational clamping by frontal coupling being included between the cap (15) and the rolling ring (10), the spacer (14) having a frontal abutment (33) against the cap (15) and abutment means (40) against the rolling ring (10) and being associated axially with the cap (15) by means of key means (23), the key means (23) cooperating with seatings (25) provided in the spacer (14) in a longitudinally sliding manner, the spacer (14) defining a first gap (29*a*) of a required width between the opposed surfaces of the cap (15) and of the rolling ring (10) and a second gap (29*b*) between the means (30, 31) performing rotational clamping by frontal coupling.

7 Claims, 2 Drawing Sheets

ASSEMBLY TO CLAMP A ROLLING RING

BACKGROUND OF THE INVENTION

This invention concerns an assembly to clamp a rolling ring.

The assembly to clamp a rolling ring according to the invention is applied to the field of rolling and, to be more exact, to the clamping of the rolling rings on ring-bearing shafts of a rolling mill stand.

In rolling mill stands of the state of the art of a type including ring-bearing shafts cooperating with a rolling ring, the rolling ring is normally fitted to the respective shaft by positioning in series a labyrinth-type ring containing an inner channel, the rolling ring, a cap rotatably clamped to the rolling ring and a closure flange which is associated with the shaft by means of a locking screw.

The rotational clamping of the cap to the rolling ring is normally ensured by frontal coupling elements of a male and female type which are included respectively on the opposed surfaces of the cap and of the rolling ring.

A spacer is inserted between the rolling ring and the cap so as to ensure the presence of a gap therebetween of a desired value and thus to prevent direct contact between the cap and the rolling ring.

This spacer is fitted to an alignment bush which cooperates with the rolling ring and with the cap.

In clamping assemblies of the state of the art the spacer is clamped to the cap by means of a screw thread, this type of clamping entailing a plurality of problems about which users have complained for a long time.

In particular, where the rolling ring has not been properly installed during the clamping and unclamping operations, the spacer is stressed in an anomalous manner with a resulting stripping of the screw thread and with a consequent inability to re-use the system.

SUMMARY OF THE INVENTION

The present applicants have designed, tested and embodied this invention to overcome the shortcomings of the state of the art and to achieve further advantages.

BRIEF DESCRIPTION OF THE DRAWINGS

The purpose of this invention is to provide an assembly for the clamping of the rolling ring to the ring-bearing shaft whereby the clamping assembly eliminates the problems linked to incorrect installation and to processing faults.

The clamping assembly according to the invention always ensures the presence of a required longitudinal gap between the rolling ring and the cap and, if this gap does not exist, does not cause damage which would render the whole system unsuitable for further use.

The clamping assembly according to the invention provides for the use of a spacer having a cylindrical alignment surface which cooperates with the cap and which enables the spacer to be displaced axially by a determined and required travel, which is advantageously of a value of some millimeters.

Clamping to prevent accidental withdrawal of the spacer from the cap during movements without the rolling ring is ensured by at least two radial keys associated with the elements providing frontal coupling of the cap and protruding towards the axis of the ring-bearing shaft, these keys are solidly fixed to the cap by clamping screw means.

The protruding part of the keys cooperates with mating seatings machined in a coordinated position on the outer surface of the spacer.

Moreover, the clamping assembly according to the invention includes wear-resistant bearing rings between the labyrinth ring cooperating with the rolling ring and the ring-bearing shaft so as to prevent any sliding being able to damage the ring-bearing shaft, above all during the beginning of the rolling of a new bar.

Figure 1:
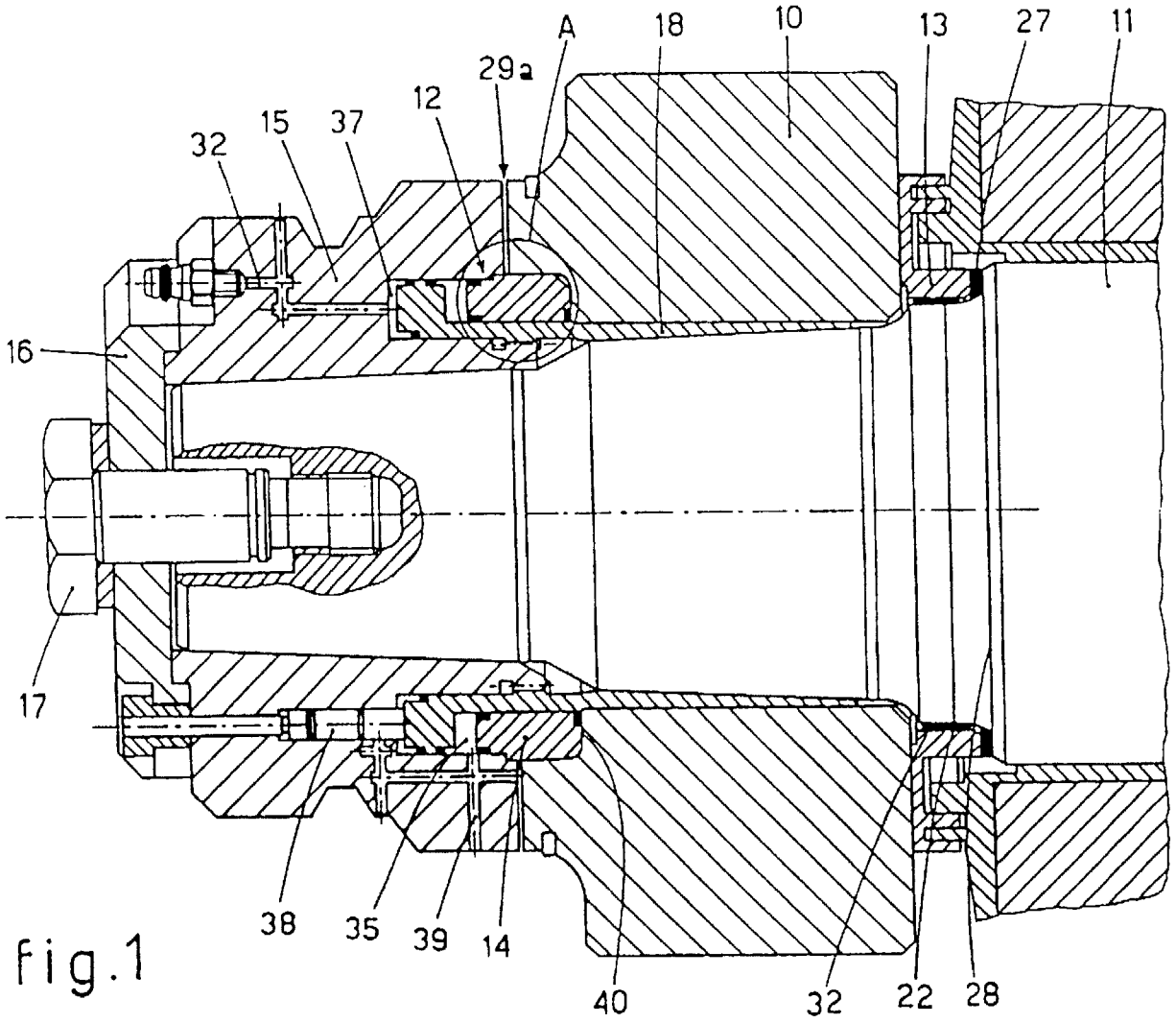
Figure 4:
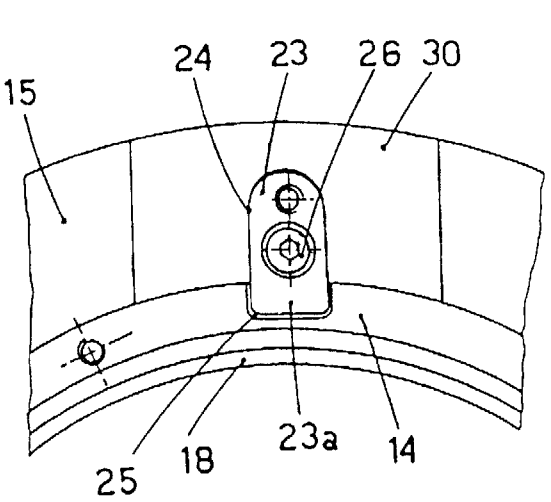
Figure 5:
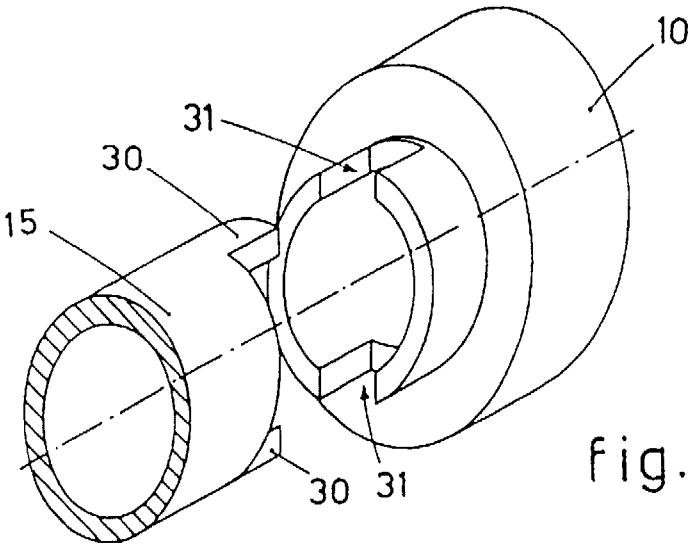
Figure 3:
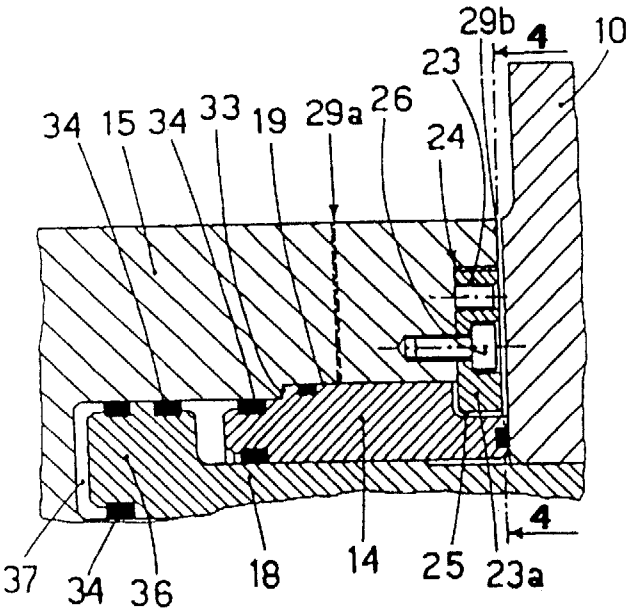
Figure 2:
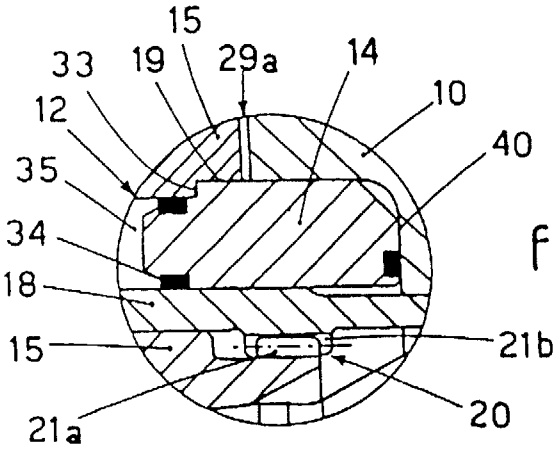

The attached figures are given as a non-restrictive example and show a preferred embodiment of the invention as follows:

FIG. 1 shows a longitudinal section of a clamping assembly according to the invention as fitted to a ring-bearing shaft;

FIG. 2 shows in an enlarged scale the detail "A" of FIG. 1;

FIG. 3 shows a partial longitudinal section of the clamping assembly of FIG. 1 at the clamping means between the rolling ring and the cap;

FIG. 4 is a view of the clamping assembly along the line B—B of FIG. 3;

FIG. 5 is a three-dimensional diagram of the rolling ring and the cap in their disassembled position.

DETAILED DESCRIPTION OF THE PREFERRED EMBODIMENTS

The reference number 10 in the figures denotes a rolling ring associated with a ring-bearing shaft 11 of a rolling mill stand, which is not shown here.

The rolling ring 10 cooperates with a clamping assembly 12, which ensures longitudinal and rotational clamping of the rolling ring 10 to the ring-bearing shaft 11 and which ensures at the same time a ready installation/dismantling of the rolling ring 10.

The clamping assembly 12 according to the invention comprises a labyrinth-type ring 13 containing an inner channel, a spacer 14, a cap 15, a closure flange 16, a locking screw 17 and a tapered alignment bush 18 cooperating both with the rolling ring 10 and with the spacer 14 and cap 15.

In this case, the labyrinth ring 13 cooperates with a wear-prevention spacer 27, which abuts against a ledge 28 of the ring-bearing shaft 11 and includes between the labyrinth ring 13 and the ring-bearing shaft 11 a bearing 22 having the function of a wear-prevention ring.

The spacer 27 and the bearing 22 may be associated with each other also to form one single body.

The rotational clamping of the cap 15 to the rolling ring 10 is ensured by frontal male coupling elements 30, which are included on the surface of the cap 15 and which cooperate with mating female elements 31 included in the opposed surface of the rolling ring 10.

In this case, each of the frontal male 30 and mating female 31 coupling elements comprises two diametrically opposed elements, as shown diagrammatically in FIG. 5.

In the clamping assembly 12 according to the invention the cap 15 has a cylindrical alignment surface 19 including a frontal abutment surface 33 which abuts against the spacer 14.

The spacer 14 includes packings 34 cooperating with a first chamber 35 machined in the cap 15 in cooperation with the alignment bush 18.

In a second chamber 37 machined in the cap 15 is lodged also a head 36 of the alignment bush 18, this head 36 too being equipped with relative packings 34.

Pins 38 cooperate with the head 36 and clamp the alignment bush 18 mechanically in the clamping position.

A first feeder conduit 39 cooperates with the first chamber 35, while a second feeder conduit 32 cooperates with the second chamber 37.

The spacer 14 includes abutment means 40 that cooperate with the rolling ring 10.

The clamping assembly 12 according to the invention comprises also rotation-prevention means 20 between the tapered alignment bush 18 and the cap 15. In this case the rotation-prevention means 20 include a tooth 21*a* associated with the inner surface of the tapered alignment bush 18, this tooth 21*a* being engaged with a mating tooth 21*b* located in a coordinated position on the cap 15.

So as to prevent accidental withdrawal during movements without a rolling ring 10, the spacer 14 in the clamping assembly 12 according to the invention is clamped to the cap 15 by keys 23 positioned in seatings 24 machined in the male frontal coupling elements 30 and including a protruding part 23*a* facing towards the axis of rotation of the ring-bearing shaft 11.

This protruding part 23*a* cooperates with a seating 25 of a mating form machined in the spacer 14 so as to ensure reciprocal circumferential clamping that permits longitudinal sliding of the spacer 14.

Each key 23 is associated with the cap 15 by means of a fixture screw 26, which, in the event of incorrect functioning or clamping, breaks and thus prevents more severe damage.

During the installation step the distance between the frontal abutment 33 and the abutment means 40 has the effect that a first longitudinal gap 29*a* of a required value is always present between the opposed surfaces of the rolling ring 10 and of the cap 15; a second gap 29*b* is also present between the frontal coupling elements 30, 31.

We claim:

1. A combination of a rolling ring, a ring-bearing shaft and an assembly for clamping the rolling ring to the ring-bearing shaft, comprising:

a longitudinally extending ring bearing shaft having an intermediate ledge;

a labyrinth ring provided on the ring bearing shaft abutting the intermediate ledge;

a rolling ring provided on the ring bearing shaft and abutting the labyrinth ring;

a cap for clamping the rolling ring of the ring bearing shaft, the cap having a coupling element cooperating with a mating coupling element provided on an opposed surface of the rolling ring to provide rotational clamping of the rolling ring;

an alignment bush having a circumferential head provided in a chamber in the surface of the cap opposing the rolling ring and having a circumferential tapered section extending longitudinally from the head and, provided between the rolling ring and the ring bearing shaft;

a closure flange for locking the cap on the ring bearing shaft by a locking screw; and a circumferential spacer provided between the cap and the rolling ring, the spacer having a first abutment surface which abuts against the rolling ring and a second abutment surface which abuts against a frontal abutment surface of the cap, the spacer being associated axially with the cap by a key fixed to the cap, the key cooperating with a seating provided in the spacer to ensure reciprocal circumferential clamping that permits longitudinal sliding of the spacer, the spacer defining a first gap of a required width between opposed surfaces of the cap and the rolling ring and a second gap between the coupling element of the cap and the mating coupling element of the rolling ring.

2. A combination as in claim 1, further comprising rotation-prevention means between the alignment bush and the cap.

3. A combination as in claim 2, in which the rotation-prevention means comprise circumferential teeth which mesh with each other.

4. A combination as in claim 1, further comprising at least one intermediate wear-prevention bearing ring positioned between the ring-bearing shaft and the labyrinth ring.

5. A combination as in claim 1, further comprising a spacer provided between the labyrinth ring and the intermediate ledge of the ring-bearing shaft.

6. A combination as in claim 5, in which the spacer is lodged so as to be able to slide in a first chamber.

7. A combination as in claim 6, in which the head of the alignment bush is lodged in a second chamber.

* * * * *